US008490277B1

(12) United States Patent
Dahood

(10) Patent No.: US 8,490,277 B1
(45) Date of Patent: Jul. 23, 2013

(54) GARBAGE DISPOSAL INSTALLATION TOOL AND METHOD OF USE THEREOF

(76) Inventor: Michael K. Dahood, Memphis, TN (US)

( * ) Notice: Subject to any disclaimer, the term of this patent is extended or adjusted under 35 U.S.C. 154(b) by 307 days.

(21) Appl. No.: 13/088,076

(22) Filed: Apr. 15, 2011

(51) Int. Cl.
*B21D 39/00* (2006.01)
*B25B 27/00* (2006.01)

(52) U.S. Cl.
USPC ..... 29/525.01; 29/559; 29/270; 29/284; 4/DIG. 4

(58) Field of Classification Search
USPC ..... 4/661, DIG. 4; 29/525.01, 525.02, 29/559, 240, 242, 270, 271, 281.1, 283, 284
See application file for complete search history.

(56) References Cited

U.S. PATENT DOCUMENTS

| | | | |
|---|---|---|---|
| 2,782,057 | A | 2/1957 | Moore, Jr. |
| 4,135,258 | A | 1/1979 | Braga et al. |
| 4,411,054 | A | 10/1983 | Zeilenga |
| 4,835,798 | A | 6/1989 | Hernandez |
| 6,044,502 | A | 4/2000 | Fountain |
| 6,142,460 | A | 11/2000 | Irwin |
| 6,557,229 | B1 | 5/2003 | Ricci |
| 6,564,679 | B1 | 5/2003 | Llamas et al. |
| 6,618,873 | B2 | 9/2003 | Mulgrew et al. |
| 6,895,838 | B2 | 5/2005 | Stahnke |
| 7,024,743 | B2 | 4/2006 | Heaton |
| 7,185,408 | B1 | 3/2007 | Keith |
| 7,401,392 | B1 | 7/2008 | Ramsey |
| 7,458,141 | B2 | 12/2008 | Goldburt et al. |
| 7,685,689 | B1 | 3/2010 | Del Castello |

*Primary Examiner* — Jermie Cozart
(74) *Attorney, Agent, or Firm* — Wyatt, Tarrant & Combs, LLP; William S. Parks

(57) ABSTRACT

A tool to aid in the installation of garbage disposal units through the facilitation of lifting such a unit to the drain portion of a sink is provided. Such a tool permits a single user to retain and maneuver a disposal unit into position in order to facilitate attachment thereof to a sink drain with reliability and consistency. Such a tool includes moveable rods of sufficient strength and rigidity to accommodate the disposal unit weight at specific levels such that the user may place and lift the disposal unit on demand without deleteriously effecting the finish or other portions of the subject sink to marring during such installation. The method of installation utilizing such a manual tool is encompassed within the invention as well.

10 Claims, 4 Drawing Sheets

GARBAGE DISPOSAL INSTALLATION TOOL AND METHOD OF USE THEREOF

FIELD OF THE INVENTION

A tool to aid in the installation of garbage disposal units through the facilitation of lifting such a unit to the drain connection point of a sink is provided. Such a tool permits a single user to retain and maneuver a disposal unit into position in order to facilitate attachment thereof to a sink drain with reliability and consistency. Such a tool includes moveable pins of sufficient strength and rigidity to accommodate the disposal unit weight at specific levels such that the user may place and lift the disposal unit on demand without deleteriously affecting the finish or other portions of the subject sink or garbage disposal unit itself during such installation. The method of installation utilizing such a manual tool is encompassed within the invention as well.

BACKGROUND OF THE INVENTION

Garbage disposals have been prevalent in home kitchens for many years and provide the capability of rendering waste food materials into acceptable liquefied condition to permit disposal into a standard sewer or septic system. Prior to the availability of such devices, consumers necessarily removed and scraped all solid waste food materials from dining plates and utensils in order to prevent clogging of the plumbing line through accumulation of such undesirable items. As such, food disposal units have proven to be one of the more common appliances found in homes throughout the United States.

Older homes (i.e., pre-1970 or so) were not built with such devices, and thus may have been or may be subject to upgrading through installation of such garbage disposals today. As well, there are instances where older units may require removal for repair or outright replacement if the unit fails. In any of those scenarios, the homeowner is forced to install such a device, either through the retention of a plumbing professional or undertaking such a task on his own. Likewise, during the actual construction of a new home, homebuilders do not typically purchase entire sink/disposal combinations, but must first install the sink and then ultimately install the garbage disposal unit separately. In any event, installation of food/garbage disposal units to already-present sinks is a common event for which there is a lack of tools provided within the pertinent industry to aid in such an endeavor. As a result, disposal unit installation may benefit from the employment of at least two persons to lift, center, and attach such a bulky, cumbersome device to a sink drain; single-person installation is difficult and cumbersome since the ability to hold a disposal unit in place and simultaneously attach the same to a drain opening requires strength and persistence by the installer to perform all such installation tasks (including lifting, centering, and leveling) prior to drain attachment. The weight of certain disposal units (such as those that are rather large, run quieter, and provide stronger grinding capability) can exceed 18 pounds. As such, these heavier disposal units generally require an installer to raise the unit from underneath a subject sink while lying on his back inside the vanity that supports the sink or, alternatively, squatting outside the subject vanity that supports the sink. Consequently, such an installation procedure permits the installer a view of only one or two of the connection points (three such points are typical) that must be engaged to secure the disposal unit hanging while centered and leveled from the sink connection points to create the necessary watertight seal to prevent leakage during use. As well, the longer a single installer works on making a good connection, the greater his chances for injury as muscles tend to tire over time when lifting and temporarily supporting such heavy and cumbersome loads. The connection between sink and disposal unit must be flush and centered in order to provide reliable flow-through into the disposal unit during utilization as well; any misalignment could prove problematic and could lead to undesirable leaks, if not total failure, of the entire sink/disposal system, as alluded to above. Thus, the only current manner of reliable installation either requires a single person of such abilities, or a team of installers working in concert to such an end. A tool that provides a single installer potential without requiring difficult placement estimates and/or uncommon strength (not to mention the possible utilization of unreliable supports, such as a jack, blocks, bricks, books, buckets, and the like, under the disposal unit during installation), is highly desirable within this specific industry.

To date, there has been only one installation tool of any significance that has provided a modicum of convenience to aid within the food/garbage disposal unit installation area. U.S. Pat. No. 6,557,229, to Ricci, discloses a tool that includes a threaded rod with a conical bottom portion and two plates with round cut-outs sized appropriately for introduction of the threaded rod; the lower of the two plates rests on the conical bottom portion which allows the plate to tilt on demand and return in place thereafter. The lower plate is thus introduced through a sink drain and then into the opening of the subject food/garbage disposal unit and the upper plate rests on the external top perimeter of the sink drain. Apparently, the user then operates the threaded rod through rotational movement to basically engage the plates in a screw-type manner in order to use the top plate as a weight to balance the weight of the disposal that is lifted through the bottom plate upward movement until the unit and the sink drain are aligned for attachment. Such a device suffers from a number of drawbacks, in particular the utilization of metal plates that could mar both the external sink drain as well as the internal cavity of the disposal unit. As well, such a device is not easily adjustable if the user misaligns the disposal unit with the drain opening since the weight of the entire disposal is dependent on the top plate's position on the external sink area. Additionally, the user must introduce an entire plate through two openings that are smaller in diameter than the length of the bottom plate diameter itself. The ability to tilt the plate in relation to the conical base may allow for such movement; however, the plate's size itself militates against manual maneuvering through even one opening, let alone two in succession. As such, this previously patented tool does not provide an effective manner of meeting the necessities of a reliable single user installation procedure. The actual workability of the overall device is questionable since the diameter of the circular lower plate would not appear to allow passage thereof through a narrower drain, regardless of any tilt of the plate during installation. It would seem, conversely, that any circular plate that could properly pass through a subject drain through a simple tilt procedure would not appropriately engage the rims of a subject disposal unit roof to accord the necessary reliable lift means for disposal unit installation to occur.

Thus, to date, there still exists a need to provide an effective tool for food/garbage disposal installation, particularly for a single person installation. The inventive tool described and disclosed herein overcomes these prior deficiencies.

ADVANTAGES AND SUMMARY OF THE INVENTION

A distinct advantage of the present invention is the ease in manipulation and maneuvering the tool allows for the user prior to, during, and after installation (particularly as a lightweight article). Another advantage of the invention is the small size and low storage area needed for such a tool. Yet another advantage is the low propensity for the tool to mar or disfigure any of the surfaces involved with such an installation procedure. Still another advantage of the invention is the ability to reuse the tool if necessary in the future for similar installation tasks.

Accordingly, the invention encompasses a tool for the installation of a food/garbage disposal unit within a sink and plumbing system, wherein said tool includes a substantially straight-line main support tube and a first and second rod, wherein said support tube that is defined by a central vertical axis length that is greater than its diameter and wherein said tube exhibits an outer periphery having dimensions that permit introduction through the opening of a sink drain and the opening of the upper grinding chamber of a food disposal unit; wherein said main support portion includes a first set of holes present on opposite edges of said outer periphery and a second set of holes present on opposite edges of said outer periphery, wherein said first set of holes allows for insertion of said first rod through both of said first set of holes simultaneously such that said first rod extends perpendicularly from the central vertical axis of said support tube; wherein said second set of holes allows for insertion of said second rod through both of said second set of holes simultaneously such that said second rod extends perpendicularly from the central vertical axis of said support tube; wherein said first set of holes is disposed at a preselected location on the outer periphery of said main support tool such that said location is a distance from said second set of holes that equals the distance from the outer edge of said sink drain and the inner rim of the roof of said upper grinding chamber of said food disposal unit when said sink drain and said disposal unit are in initial contact with one another prior to attachment of properly aligned and complementary configured connection points; wherein said first rod exhibits a length greater than the diameter of said sink drain; wherein said second rod exhibits a length greater than the diameter of the opening of said upper grinding chamber; and wherein both of said first and second rods are constructed from material of sufficient strength to securely hold the weight of said disposal unit when oriented horizontally through said first and second sets of holes, respectively. Also encompassed within this invention is the method of installation utilizing such a tool. Broadly presented, the inventive method includes the steps of:

a) providing a straight-line tube having a central vertical axis with first and second support components, wherein both of said first and second support components are of sufficient strength to withstand the weight of a food disposal unit when lifted vertically;

b) introducing such straight-line tube i) initially through a sink drain of a certain diameter, wherein said sink drain includes an upper exterior surface, and wherein said sink drain includes attachment means for connection with a food disposal unit; and ii) subsequently, into the upper grinding chamber of a food disposal unit, wherein said upper grinding chamber has a certain diameter, wherein said upper grinding chamber has a roof with a rim, and wherein said food disposal unit includes attachment means for connection with complementary configured attachment means with said sink drain; wherein said introduction is made from a position above both of said sink drain and said food disposal unit;

c) engaging said first support component with said rim of said upper grinding chamber such that said first support component is in contact with said rim at two opposite points and wherein said first support component has a length greater than the diameter of said upper grinding chamber;

d) lifting said food disposal unit through the engagement of said first support component with the rim of said upper grinding chamber to a point at which said sink drain attachment means and said food disposal attachment means are initially in contact with one another;

e) engaging said second support component with said external surface of said sink drain such that said second support component is in contact at two opposite points and wherein said second support component has a length greater than the diameter of said sink drain; and f) attaching said sink drain to said food disposal unit through engagement of said sink drain attachment means and said food disposal unit attachment means.

The inventive tool, as noted above, is designed primarily as a tool to assist installers of sink food disposal units weighing more than 18 pounds (8.2 kilograms). Such installation allows for access from above the subject sink and lifting of the unit into flush alignment for ultimate attachment therewith to the subject sink drain. Basically, an installer is allowed to insert a support bar (moveable rod) into the interior of a food disposal unit's upper grinding compartment, extend that support bar once therein, and subsequently raise (lift) the entire unit so that the food disposal unit can be temporarily supported, centered and leveled without any other assistance, be it manual or mechanical to retain such a position (the installer would not need to lift the unit from below the sink drain and would only need to go under such a sink to perform the unit/drain attachment step). The entire unit can then be suspended by a second support rod disposed above the exterior of the sink drain, bearing all the weight associated therewith, and disposed appropriately to allow for the above-noted flush alignment of unit and sink drain without any further lifting or manipulation.

The tool itself includes a main portion that may be made from any sufficiently strong material to withstand application of at least 25 pounds (11.4 kilograms) of pressure applied longitudinally thereto and that may be hollowed to a degree that allows for support rod storage while still maintaining the ability to withstand the weight noted above. Thus, thermosets, thermoplastics, metals, woods, and the like, may be employed for this purpose. Preferably, the main body portion is constructed from polyvinylchloride pipe (with, as one non-limiting example, a pressure rating of S40), and drilled with appropriately located holes to permit introduction of the support bars (rods) therethrough. The main portion should be straight in configuration and preferably of a length sufficient to permit a reach through a sink drain and into the upper cavity (i.e., the upper grinding compartment) of a food/garbage disposal unit disposed below such an opening, as well as to then provide a sufficient amount of material for an installer to grab and utilize to lift such a unit upward up to the bottom of the subject sink drain. Thus, any length from between 10 inches (25.4 centimeters) and 2½ feet (76 cm) would be suitable. Greater lengths may be employed if needed, depending on the sink configuration and weight of the unit. Alternatively, the inventive tool may be inserted into the upper grinding chamber of the subject food disposal unit prior to relocating that unit beneath the drain opening and inside the supporting vanity/cabinet that supports the sink. The user may then reach through the sink drain opening or, alternatively, use an appropriate tool to grab the tube (such as through an attached rope loop) and provide access of the same through the sink drain opening. The remaining process steps would then be the same as discussed herein.

Such a main portion may be of any shape, as long as the shape does not impede introduction of such a portion within the openings of the subject unit and sink drain, and permits access for the installer to visually observe proper alignment of the bottom rod during the disposal unit engagement step. Preferably, the main portion is cylindrical in shape, for ease in manufacturing, gripping during use, and overall simplicity of design, although square, triangular, oval, or other like geometric shapes at the top and bottom of the main portion may be provided as long as the other criteria noted above are met. The cylindrical shape would thus provide a circular edge on both ends, preferably exhibiting a diameter of from ⅝ inch (1.4 cm) inch to 1 inch (2.54 cm).

The hollowed out area within the main portion allows access for storage of the support bars (rods) (as noted above) (and other paraphernalia that may be utilized, such as a lifting implement, such as a rope, metal bar, and the like). Removable caps may be placed on the two ends of the main tool portion during such storage to ensure retention of such implements therein.

The support bars (rods) are likewise constructed from sufficiently strong material to withstand the same weight as noted above for the main body portion, but from a horizontal position, rather than in terms of vertical application. Additionally, however, the rods should not exhibit a propensity to damage a surface on or within the subject sink or disposal unit when applied thereto. As such, the rods may be of metal in nature, but preferably if a softer material is supplied on the exterior of the ends thereof to protect such surfaces from marring during use (such as rubber, as one non-limiting example). As well, such support bars may be made from carbon fiber, polyaramid fiber, and other known strong polymers. Most preferably, however, the rods are made from fiberglass due to the suitable surface such materials provide in terms of potential marring as noted above. The rods are preferably of relatively high aspect ratio (short length as compared with end diameter) to allow for proper introduction of the bottom rod within the upper cavity (grinding compartment) of the subject disposal unit during installation and ease in manipulation to allow for the ends of such a rod to engage the interior rim or roof of said upper grinding chamber (or cavity) for reliable lifting to occur. Such a bottom rod is preferably shorter than the top rod in order to compensate for the narrow opening in the top of the grinding compartment of the disposal unit and the drain and the possible low amount of surface area for the ends thereof to contact the interior roof of the upper cavity during engagement. With a typical grinding compartment diameter being roughly 3⅞ inches in width, the bottom rod should be anywhere from 4¼ inches to 4⅝ inches in length, preferably about 4⅜ inches including at least one removable end cap on the lower rod (if desired, two end caps may be employed on each end of the lower rod, as well, to ensure the rod will not fall from the tube and into the disposal unit). The top rod may be of any length suitable to extend longer than the diameter of the subject sink drain, as long as it is able to remain in place without tilting or bending during installation. Thus, with a standard drain diameter of 4 inches, greater than 4½ inches would be recommended, with at least 4⅝ inches, up to 6 inches, preferred for such a purpose. The rods themselves may be of any diameter themselves, and preferably cylindrical in shape as well. However, if desired, as well, the user may employ a lower rod with a flat edge on the end cap, or within both the end cap and the opposite rod end, and an upper rod with at least one flat edge on at least one end, all to permit better engagement with the disposal unit rum as well as for proper placement on the surface of the drain exterior.

The rods may either be provided as integrated or loosely attached parts of the main body portion. Preferably, the main body portion includes drilled holes through which the rods are allowed to pass in order to engage with the subject surfaces noted above within the subject sink and disposal unit. In such an instance, as the rods may be of any diameter, the holes within the main body should be of sufficient diameter to allow for such placement and movement of the rods themselves. The rod diameters are preferably from about ¼ inch to ¾ inches, and thus the holes within the main body portion are configured to accept such measurements. Most preferably, the diameter of the rods is ¼ inch, and thus the drilled holes should be roughly 17/64 inch to accommodate such items. The holes on the main body are also to be configured specifically to meet the distance between the rim of the grinding compartment of the disposal unit and the top surface of the sink drain exterior in order to allow, as discussed previously, the placement of the top rod on the drain surface and the bottom rod on the interior roof of the disposal where contact between the disposal and the sink drain bottom is flush for proper alignment and connection. As this measurement is roughly standardized to be about 2⅞ inches, the distance of the hole sets should be 2 15/16 inches. As well, to allow for a certain amount of the main body portion to support the support rods when in use, there should be at least 1 inch of distance between the bottom rod holes on the main body portion and the bottom edge thereof. Lastly, although the holes present within the main body portion may be disposed in any configuration, as long as the proper distances are provided for the flush connections to be obtained, as noted above, between the sink drain bottom and the top of the disposal unit, such may be aligned to permit the bottom rod to be present in a horizontal direction when inserted through the main body portion that is disposed ninety degrees from the horizontal direction in which the top rod is present. In such a situation, the ninety degree difference allows for more reliable placement and overall capture of the disposal unit from the sink exterior location, thus improving the ability for the installer to level and center the overall combination prior to and during connection. As well, if desired, the support bars (rods) may include notches that indicate the periphery of the main body portion to allow for even more reliability as to the centered location of the disposal unit during installation.

The bottom rod should also include at least one end cap of a diameter greater than that of the drilled holed on the main body portion in such that only one end of the bottom rod could be introduced therein (or, more importantly, such that only one end would allow for removal therefrom). Such a cap allows the installer to tilt the main body portion at an angle that permits introduction of the bottom rod into both the sink drain and the upper cavity of the disposal unit. Without the cap, the tilting action would allow for the inadvertent removal of such a vital component into the grinding compartment of the disposal unit, not to mention would not permit effective utilization of the tool itself. Although only a single cap is necessary, if desired, the user could apply a second cap to the other end of the bottom rod to permit even greater reliability in terms of possible loss of the rod, as well as to potentially provide a more even engagement level during lifting and installation of the disposal unit.

As noted above, the main body portion may also include a lifting or retrieving implement as well. To that end, a sturdy rope may be attached via holes (similar to those drilled for the support bar insertion purposes) disposed about 1 to 2 inches from the top edge of the main body portion and tied thereto. Such a rope may be then dropped into the hollow portion of the main body during storage. A third support bar may also be included to be inserted through such top edge holes in order to provide further lifting capability, if desired. The tool may thus also include a cap to retain such items within the hollow tube during storage and transport.

Such a tool can thus be modified to work effectively with any currently available food disposal unit that has a grinding compartment with a diameter wider than the diameter of the drain on the sink to which the food disposal is attached when it is ready for use.

BRIEF DESCRIPTION OF THE DRAWINGS

Without any intention of limiting the scope of the present invention, the following drawings provide one possible embodiment thereof.

DETAILED DESCRIPTION OF THE DRAWINGS AND PREFERRED EMBODIMENTS

Figure 1:
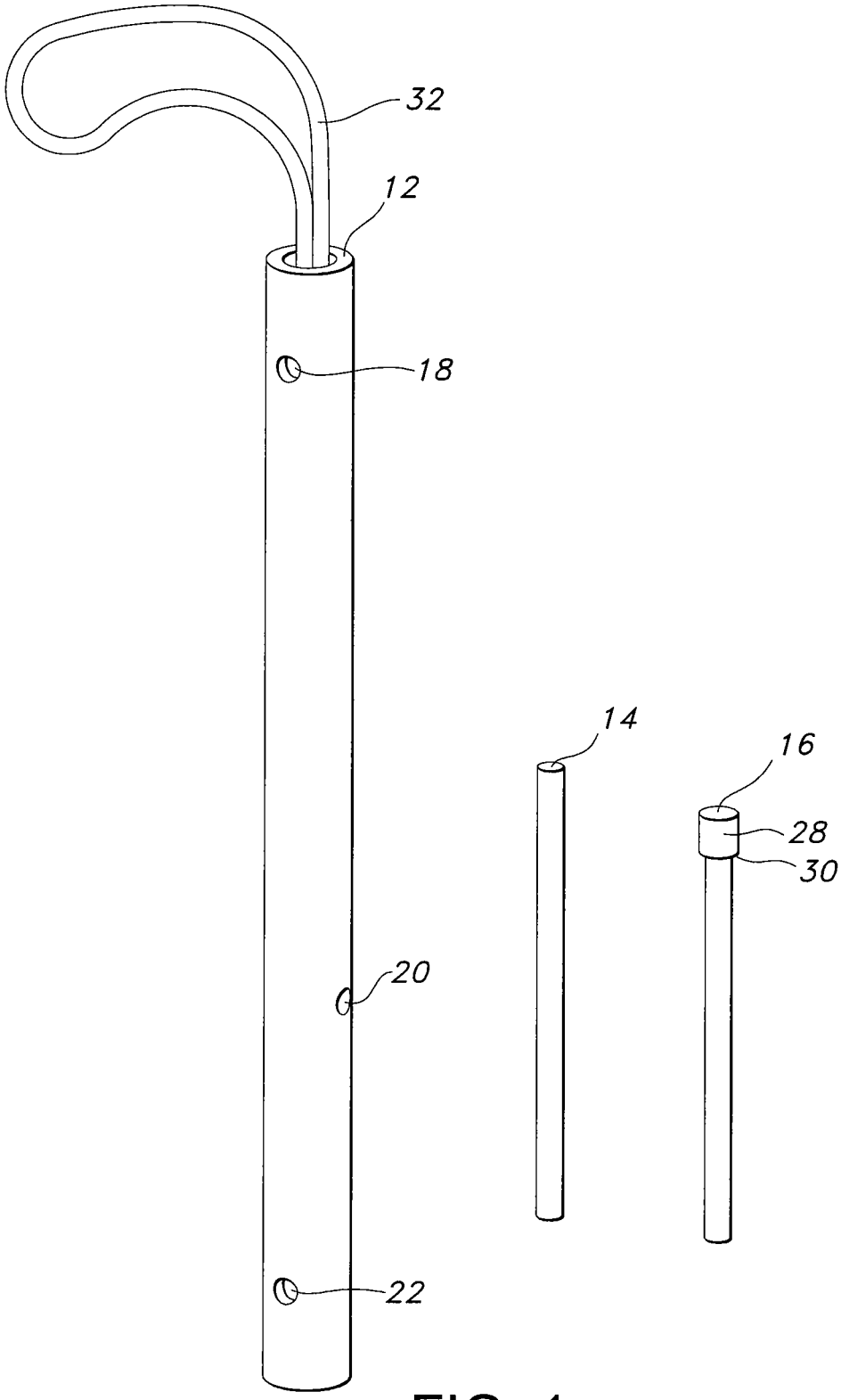
FIG. 1 depicts one embodiment of the tool in separated view.

FIG. 1 thus provides a three component tool in accordance with the invention described herein. A main body portion 12 (here a PVC tube) is provided being cylindrical in shape and with a hollowed out interior, including three sets of holes 18, 20, 22 disposed at predetermined locations in the main body portion 12. The first set 18 is situated to provide attachment for a rope 32 that may be used for lifting or retrieving (if the installers loses grip during lifting). Such first holes 18 disposed here in the general direction as those of the third set 22 through which a bottom support bar (rod) 14 is to be introduced. A second set of holes 20 is provided in a direction that is disposed 90 degrees from those of the two other sets 18, 22 and through which a top support bar (rod) 16 is to be introduced. The bottom support bar 16 is 4⅜ inches in length, ¼ inch in diameter, and made from fiberglass. As well, such rod 14 includes a cap 28 made from hard rubber that exhibits a diameter of 5/16 inch and has an internal edge 30.

Figure 2:
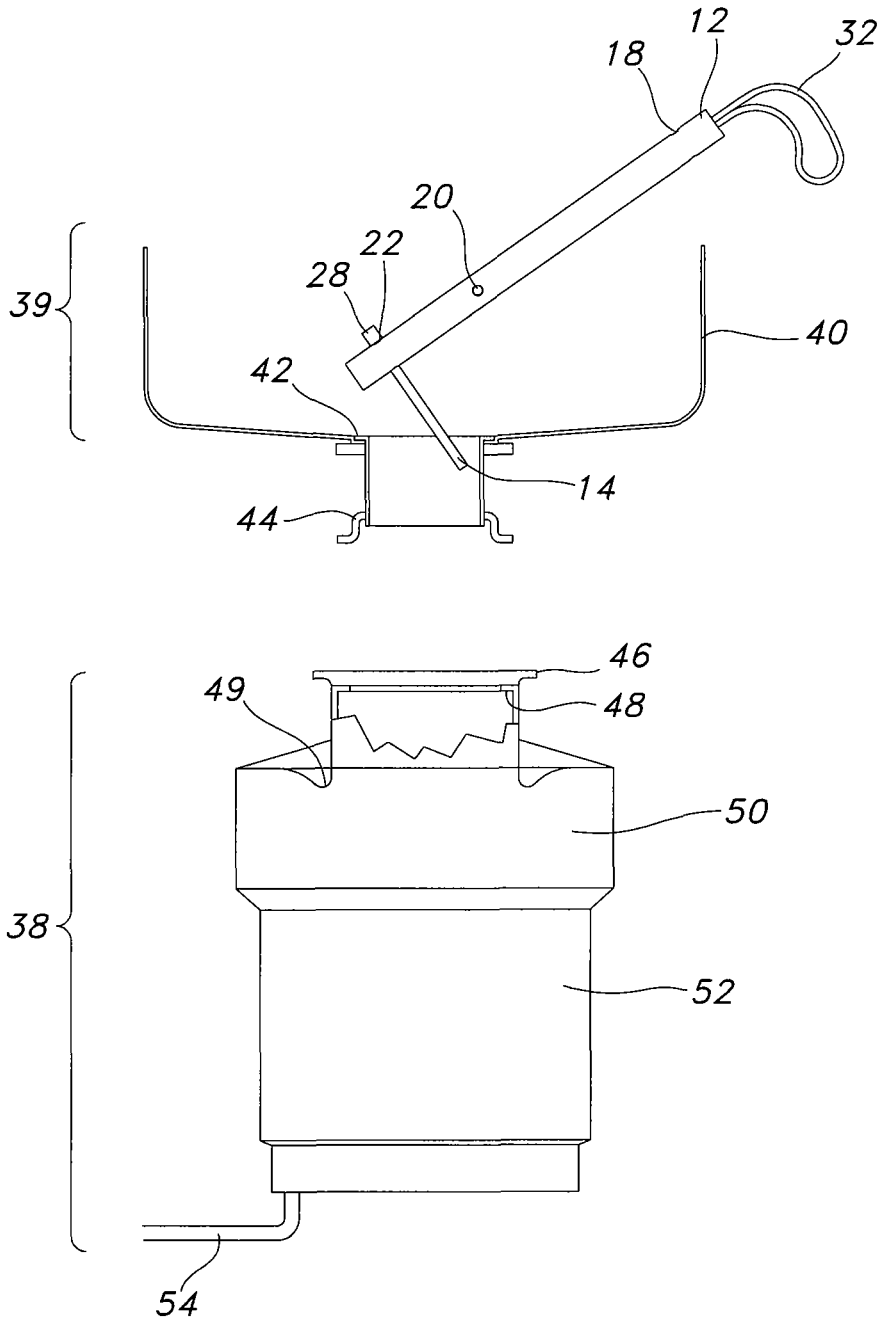
FIG. 2 shows the first step in utilizing the tool of FIG. 1 in a disposal unit installation procedure.
Figure 3:
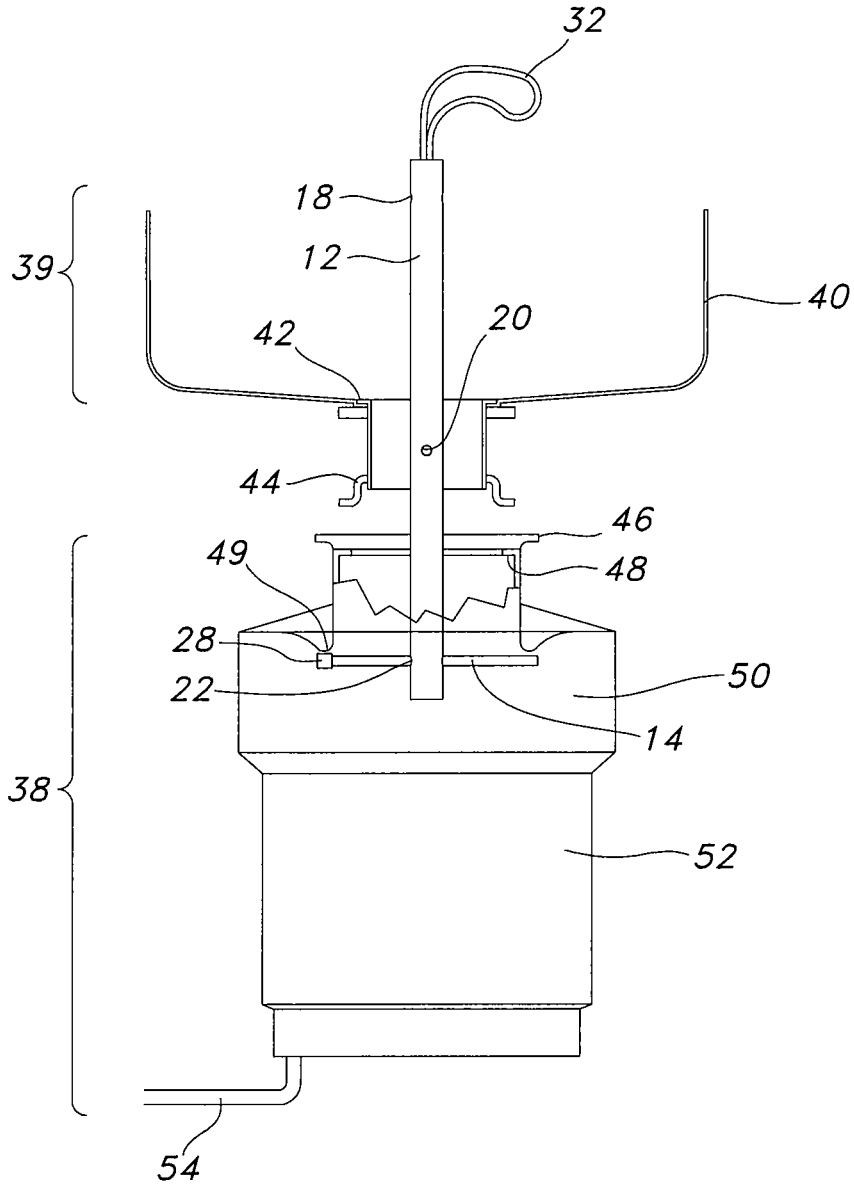
FIG. 3 shows the initial engagement of tool of FIG. 1 in a disposal unit installation procedure.

FIG. 2 shows the first step in utilizing the tool of FIG. 1. A sink 39 includes a tub 40 a drain 42 and a disposal ring attachment component 44 to which a disposal unit 38 may be attached. Such a disposal unit 38 includes a complementary ring attachment component 46 (for connection with the sink drain attachment component 44), a throat portion 48 leading to an upper grinding compartment 50 that exhibits a properly disposed rim (or lip) 49 at its roof line. The grinding compartment 50 leads to a storage chamber 52 which, in turn, leads to a removal pipe 54. In the first step of installation, the main body portion 12 is tilted with the bottom support bar 14 inserted within the third hole set 22 and thus extending from one exterior of the main body portion 12 to the other such that the cap 28 stops at the main body portion surface 12. This tilting action allows for the entire end of the main body portion 12, including the bottom support bar 14, to enter both the sink drain 42, through the disposal throat 48 into the disposal unit upper grinding compartment 50 for engagement therewith (as in FIG. 3). Subsequent to such introduction, as shown in FIG. 3, the main body portion 12 is manipulated and the bottom support bar 14 is maneuvered to allow for such engagement with the upper (interior roof) rim 49 of the disposal unit 38. From this position, the installer may then lift the main body portion 12 while the bottom support bar 14 remains in place and engaged with the rim 49 in order to align the drain coupling component 44 and the disposal complementary attachment component 46 for ultimate connection between the two (FIG. 4) (such components are provided in various configurations, although one common one is the Quick-Lock arrangement from In-Sink-Erator that includes a replacement sink drain component with a lower extended attachment ring assembly that is complementary in shape and alignment to that provided by the associated food disposal unit; as well, it is common for the installer to utilize a proper sealant, such as putty, and the like, to such a ring prior to attachment between the two components to increase the seal between such components to reduce leakage potential). In actuality, the attachment components 44, 46 are configured to such a degree as to allow for the disposal component 46 to be aligned and merely in contact with the drain component 44 to permit attachment through rotation of the disposal component 46. During such rotation, the disposal component 46 is maneuvered and engages a slightly inclined slope in the drain component 44 such that a minimal rotation (for example, $1/3^{rd}$ of a turn), aligns three extended attachment devices (not illustrated) to effectuate the desired connection between sink component 44 and the disposal component 46, thus providing a secure seal therebetween. As a result, the distance between the two sets of holes 20, 28 including the rods 14, 16 of the tool 18 are not spaced accordingly to the distance between the external sink drain 42 and the rim 48 of the upper grinding chamber 50 of the disposal unit 38 when secured through such a sealed connection. To the contrary, the distance between such sets of holes 20, 28 mirrors the distance between the sink drain 42 and the rim 48 of the upper grinding chamber 50 of the disposal unit 38 when the drain attachment component 44 and the disposal attachment component 46 are in initial contact with one another prior to such attachment. In that manner, once the installation is complete and the sink 39 and disposal 38 are properly attached and sealed, the resultant extra distance between the two rods 14, 16 is sufficient to permit the installer to remove the top rod 16 while slightly raising the main support 18 thereby facilitating removal of the entire tool from the completed installation.

Figure 4:
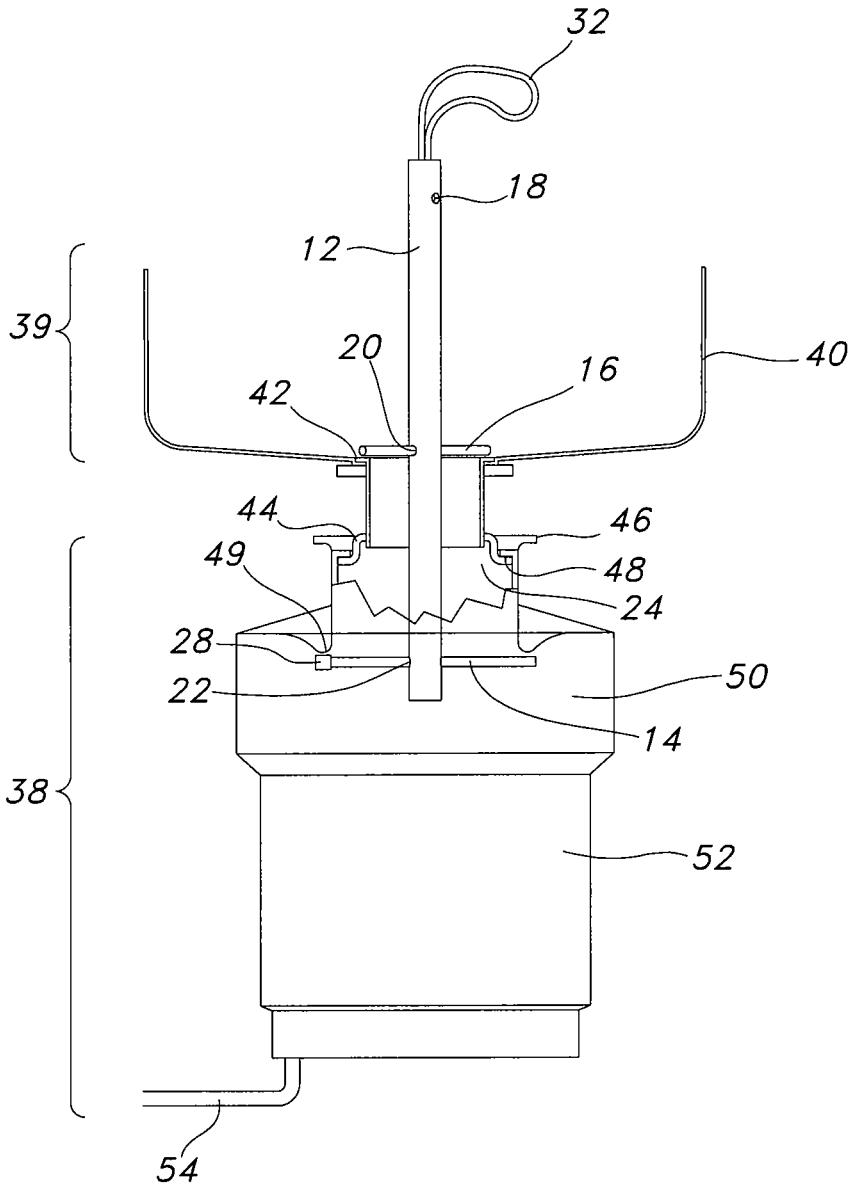
FIG. 4 shows the finished installation of a disposal unit after utilization of the tool of FIG. 1.

Thus, in FIG. 4, the installer has properly lifted the disposal unit 38 into place with the sink drain coupling component 44 and then inserted the top support bar 16 through the second set of holes 20 to allow for the weight of the unit 38 to be borne by that support bar as well as to allow for completed connection between the drain coupler 44 of the sink 39 and the attachment component 46 of the disposal unit 38. There is generally a minimal distance allowed for some degree of lifting to take place after proper alignment is accomplished due to the presence of an attachment component 46 on the disposal unit 38 that requires further upward motion (be it snap or screw-type movement), such that the flush description provided above meets this possibility. Once in place and properly connected, as noted above, the installer may then remove the top support bar 16 from the second set of holes 20 of the main body portion 12, lower the main body portion 12 (as far as the floor of the upper grinding compartment 50, if desired) and tilt it in the direction which allows for the cap 28 of the bottom support bar 14 to catch, and then remove the main body portion 12 from the disposal 38 and sink 39, leaving intact the installed disposal unit 38 for utilization in conjunction with the sink 39 as desired by a user.

Thus, a single installer has the capability to easily install such a cumbersome disposal unit on demand without any need for other aid in such an endeavor. Such a tool allows for an effective top down approach that facilitates lifting the subject disposal unit from above the sink drain, eliminating the need for the installer to be on his back or under the sink for the raising, centering and leveling part of the installation. At the same time the installer reduces his risk of personal injury and reduces the time needed to attach the disposal to the sink.

A complete disclosure of the details and essence of this invention has been made, and the best modes of practicing it as now contemplated have been presented. It will be apparent to all skilled in the art that modifications, substitutions and additions may be made in the elements of the invention without departing from its concepts, the scope of which is defined and limited only by the ensuing claims.

I claim:

1. A tool for the installation of a food/garbage disposal unit within a sink and plumbing system, wherein said tool includes a substantially straight-line main support tube and a first and second rod, wherein said support tube that is defined by a central vertical axis length that is greater than its diameter and wherein said tube exhibits an outer periphery having dimensions that permit introduction through the opening of a sink drain and the opening of the upper grinding chamber of a food disposal unit; wherein said main support tube includes a first set of holes present on opposite edges of said outer periphery and a second set of holes present on opposite edges of said outer periphery, wherein said first set of holes allows for insertion of said first rod through both of said first set of holes simultaneously such that said first rod extends perpendicularly from the central vertical axis of said support tube; wherein said second set of holes allows for insertion of said second rod through both of said second set of holes simultaneously such that said second rod extends perpendicularly from the central vertical axis of said support tube; wherein said first set of holes is disposed at a preselected location on the outer periphery of said main support tube such that said location is a distance from said second set of holes that equals the distance from the outer edge of said sink drain and the inner rim of the roof of said upper grinding chamber of said food disposal unit when said sink drain and said disposal unit are in initial contact with one another prior to attachment of properly aligned and complementary configured connection points; wherein said first rod exhibits a length greater than the diameter of said sink drain; wherein said second rod exhibits a length greater than the diameter of the opening of said upper grinding chamber; and wherein both of said first and second rods are constructed from material of sufficient strength to securely hold the weight of said disposal unit when oriented horizontally through said first and second sets of holes, respectively.

2. The tool of claim 1 wherein said tube is cylindrical in shape.

3. The tool of claim 1 wherein said at least two rods are made from fiberglass.

4. A method of installation of a food disposal unit to a sink drain, wherein said method includes the steps of:

a) providing a straight-line tube having a central vertical axis with first and second support components, wherein both of said first and second support components are of sufficient strength to withstand the weight of a food disposal unit when lifted vertically;

b) introducing such straight-line tube i) through a sink drain of a certain diameter, wherein said sink drain includes an upper exterior surface, and wherein said sink drain includes attachment means for connection with said food disposal unit, wherein said food disposal unit comprises an upper grinding chamber; and ii) into said upper grinding chamber of said food disposal unit, wherein said upper grinding chamber has a certain diameter, wherein said upper grinding chamber has a roof with a rim, and wherein said food disposal unit includes attachment means for connection with complementary configured attachment means of said sink drain; wherein said introduction is made from a position above both of said sink drain and said food disposal unit;

c) engaging said first support component with said rim of said upper grinding chamber such that said first support component is in contact with said rim at two opposite points and wherein said first support component has a length greater than the diameter of said upper grinding chamber;

d) manually lifting said food disposal unit through the engagement of said first support component with the rim of said upper grinding chamber to a point at which said sink drain attachment means and said food disposal attachment means are initially in contact with one another;

e) engaging said second support component with said external surface of said sink drain such that said second support component is in contact at two opposite points and wherein said second support component has a length greater than the diameter of said sink drain; and f) attaching said sink drain to said food disposal unit through engagement of said sink drain attachment means and said food disposal unit attachment means.

5. The method of claim 4 wherein said first and said second support components are rods.

6. The method of claim 5 wherein said rods are made from fiberglass.

7. The method of claim 4 wherein said first and said second support components are retained within said tube through the presence of appropriately sized holes to allow for disposition of said components perpendicularly to said central vertical axis.

8. The method of claim 7 wherein said first and second support components are rods.

9. The method of claim 8 wherein said rods are made from fiberglass.

10. The method of claim 4 wherein step (b)(i) is performed prior to step (b)(ii).

* * * * *